United States Patent [19]

Vukmanic

[11] Patent Number: 4,712,350

[45] Date of Patent: Dec. 15, 1987

[54] CENTERING ARRANGEMENT FOR T MEMBERS OF A SUSPENDED CEILING

[75] Inventor: Ronald W. Vukmanic, Naperville, Ill.

[73] Assignee: Chicago Metallic Corporation, Chicago, Ill.

[21] Appl. No.: 864,160

[22] Filed: May 16, 1986

[51] Int. Cl.[4] ..... E04B 5/52

[52] U.S. Cl. ..... 52/484; 52/778

[58] Field of Search ..... 52/484, 777, 778, 485–489

[56] References Cited

U.S. PATENT DOCUMENTS

| | | | |
|---|---|---|---|
| 2,882,559 | 4/1959 | Stanley . | |
| 2,894,291 | 7/1959 | Sorenson . | |
| 3,320,713 | 5/1967 | Downing . | |
| 3,325,954 | 6/1967 | Olson . | |
| 3,359,696 | 12/1967 | Snaith | 52/778 X |
| 3,370,301 | 2/1968 | Harlan . | |
| 3,475,869 | 11/1969 | Jahn . | |
| 3,536,345 | 10/1970 | Leifer . | |
| 3,640,042 | 2/1972 | Kidney . | |
| 4,470,239 | 9/1984 | Sauer . | |
| 4,489,529 | 12/1984 | Ollinger et al. . | |
| 4,679,375 | 7/1987 | Shirey | 52/777 |

FOREIGN PATENT DOCUMENTS 472037 1/1975 Australia .

OTHER PUBLICATIONS

"Donn-Acoustics" brochure, Donn Products, Inc., Feb. 1967.

Donn Corporation sales sheets, "Centricitee TM Grid System", pp. 8 and 9.

*Primary Examiner*—William F. Pate, III

*Assistant Examiner*—Richard E. Chilcot, Jr.

*Attorney, Agent, or Firm*—Hill, Van Santen, Steadman & Simpson

[57] ABSTRACT

A centering arrangement for runners of a ceiling system for holding the panels supported by the runners in a desired position on the flanges of the runners, said centering arrangement comprising a bump extending from each side of the web with the bump being formed in a web of the runner immediately adjacent a cut in the runner so that the drawing of the material into the bump will not draw material from the flange or adjacent thereto. The bump is preferably a half moon or semi-circular shape so that it provides a smooth camming surface for both lateral movement of the panel along the flange as well as vertical movement towards the flange.

7 Claims, 7 Drawing Figures

CENTERING ARRANGEMENT FOR T MEMBERS OF A SUSPENDED CEILING

BACKGROUND OF THE INVENTION

The present invention is directed to a suspended ceiling structure formed by main runners and cross runners which have an inverted T configuration with a web with two flanges extending from the base of the web to form rectangular openings which receive panels and each of the runner members is provided with centering bumps to help maintain the panels in a desired position to have maximum support thereof.

In ceiling constructions, it has always been desirable to maintain a position of the panel relative to the runner members. In Snaith, U.S. Pat. No. 3,359,696, the panels were provided with grooves and it was desired to maintain the panels relative to the flanges so that the aesthetic appearance would be maintained. In order to do this, the patentee suggests using clips which were inserted on the webs of the T members or by providing bumps such as dimples that were formed in the web and extended on opposite sides.

A concern with maintaining the position of the panels becomes more critical when utilizing runners having narrow flanges such as in the order of a total width of ½ inch to ⅝ inch so that each of the flanges has a width which is roughly less than 5/16 of an inch. With such a narrow runner, it is conceivable that the panel can be shifted into one corner in the rectangular opening so that it is not properly supported in the opposite edges or sides. This becomes particularly critical when maintaining fire reading of the panel or ceiling system. One proposal of aiding in positioning the panels to ensure proper support comprises a pair of right angle cuts with one leg of each cut extending parallel to the flange and the other being substantially vertical thereto. The material between these pair of cuts is then deformed out to form two bumps for centering purposes. Such an arrangement has been sold as the Centricitee TM Grid System. One disadvantage of this type of centering projection or bump is that the sharp edge along one side of the bent out portion may dig into the panel and prevent adjustment of the panel in the rectangular opening.

Another problem with using dimples, which was suggested by the above mentioned Snaith patent, is that the provision of the dimple when close to the flange may cause drawing or pulling of metal from the flange which would destroy its aesthetic appeal.

SUMMARY OF THE INVENTION

The present invention is directed to providing a centering arrangement in the web of a runner which would not provide any sharp edges for digging into the edge of a panel and which would not cause unsightly metal flow in the web or in portions of the flange immediately adjacent the web.

To accomplish these goals, the present invention is directed to an improvement in main runner members and cross runner members which are utilized in a ceiling system. Each of the runner members having an inverted T configuration with a vertical web and two outwardly extending flanges adjacent the bottom edge of the web, said runners being arranged in the system to provide rectangular openings for receiving panels with the edges of the panels being supported on the flanges of the member. The improvement comprises a centering means comprising a bump formed adjacent a cut in the web extending parallel to the flanges with the bump providing camming surfaces for camming the edge of the panel to the desired position whether it is inserted vertically over the bump or is being moved laterally from either side. Preferably, the bump has a half moon or semi circular configuration which opens downward towards the flange. Due to the presence of the cut between the bump and the flange, the formation of the bump will not draw material from the flange to effect its aesthetic appearance. Preferably, a pair of bumps are provided and are facing in opposite directions. Preferably each of the runner members has a narrow flange configuration.

DESCRIPTION OF THE PREFERRED EMBODIMENTS

Figure 1:
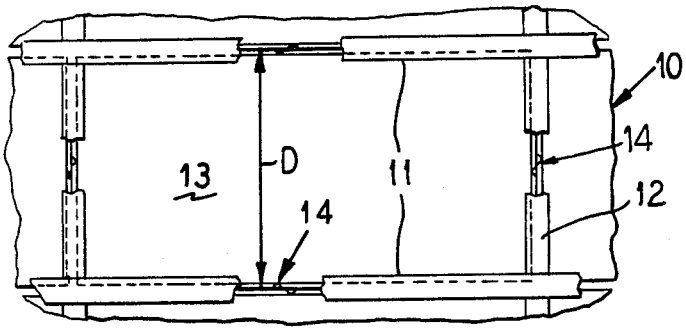
FIG. 1 is a plan view with portions broken away of a ceiling system is accordance with the present invention.

The principles of the present invention are particularly useful in a suspended ceiling system generally indicated at 10 in FIG. 1. System 10 has a plurality of parallel extending main runners or members 11 and cross members or runners 12 which are arranged to form rectangular spaces for receiving panels 13. Each of the runners or members 11 and 12 are provided with centering means 14 to aid in positioning the panel 13 in the opening formed by the members. The centering means 14 is particularly important when the runners are narrow flange runners which will be discussed hereinafter.

Figure 2:
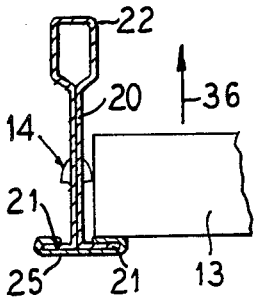
FIG. 2 is an enlarged cross sectional view of a runner in accordance with the present invention.
Figure 3:
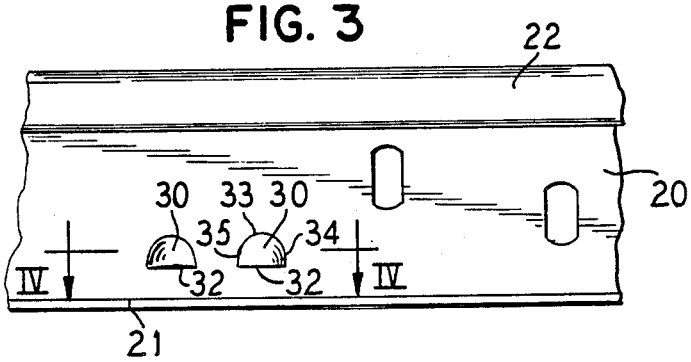
FIG. 3 is a partial side view of a runner in accordance with the present invention illustrating the positioning bumps of the invention.
Figure 4:
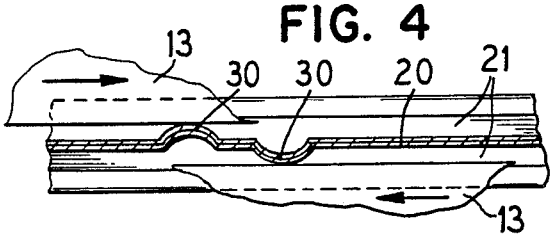
FIG. 4 is a cross sectional view taken on lines IV—IV FIG. 3.

Each of the runners as illustatred in FIGS. 2, 3 and 4 has an inverted T shape with a web 20 having two outwardly extending flanges 21. As illustrated in FIG. 2, the web 20 is formed by a sheet of metal which is bent to have a box or rectangular-shaped bead 22 and oppositely extending flange elements opposite the bead 22. A cover member 25 is crimped onto the flanges and enables providing different colors for the exposed portion of flanges which portions are illustrated such as in FIG. 1.

As illustrated in FIG. 2, the flanges 21 form a narrow flange which has an approximate width of between ½ and ⅝ of an inch. Thus, each of the flanges 21 has a width which is approximately 5/16 inch. When a panel 13 is resting on the flange and has a size slightly less than the distance D between two webs 20 of two adjacent panels, it is possible for the panel 13 to be forced against the web of one side of the opening and not be properly supported at the opposite side. Thus the panels can be supported with so small amount of flange that when expansion of the members begins to occur during a fire, the panel may fall or drop out of the opening. To overcome this problem and to help keep maintain a centering of the panel so all edges of each panel 13 are adequately supported, the centering means 14 is provided. Thus, the centering means will hold the edge of a panel 13 a distance from the web 20 so that the panel will be centered and will be properly supported on all edges of the flanges surrounding the opening receiving the panel. This will thus prevent panels which may be slightly undersized from having one edge displaced against a web so that it is inadequately supported on an opposite edge.

As illustrated, the centering means 14 comprises a pair of bumps 30, which are formed in the web with one bump being formed or pressed out of one side of the web and the adjacent bump being pressed out of the opposite side. Each of the bumps preferably has a half moon or semi circular configuration and is adjacent a slit or cut 32 which extends parallel to the flanges 21. The purpose of the cut is to prevent a drawing of the metal in the region between the bump and the flange to possibly cause a unsightly wrinkle and/or weakening of the flange. The half moon configuration is selected so that a curved camming surface is presented over at least 180°. Thus, when a panel is inserted into the opening, a crown or upper portion 33 of the bump will cam the panel away from the web 20. The right hand edge 34 and the left hand edges 35 of each bump as illustrated in FIG. 3 will allow adjustment or movement of the panel in a direction parallel to the flanges and to the web. The only sharp edge, which is a smooth continuous edge with curve portions and without breaks as illustrated, is adjacent the cut 32 and this sharp edge is directed downwardly so that it will not dig into the panel to prevent lateral movement. However, it is noted that it will possibly prevent a raising the panel 13 in a vertical direction such as indicated by the arrow 36 in FIG. 2.

The preferred embodiment has the half moon configuration with the bump projection approximately 1/16 of an inch from a surface of the web so that the panel rests on the outer $\frac{3}{4}$ of the width of the flange or if the flange is a narrow flange of approximately 5/16 of an inch on an outer portion which has a width of about 3/16 of an inch. It is believed that other configurations such as half of an octagon or a many sided figure which approach a semi circular configuration of the half moon structure with a continuous edge are useable. The only requirement is that a substantially smooth surface is provided for camming the panel to the centered position which smooth surfaces would not dig into the material of the panel.

Figure 5:
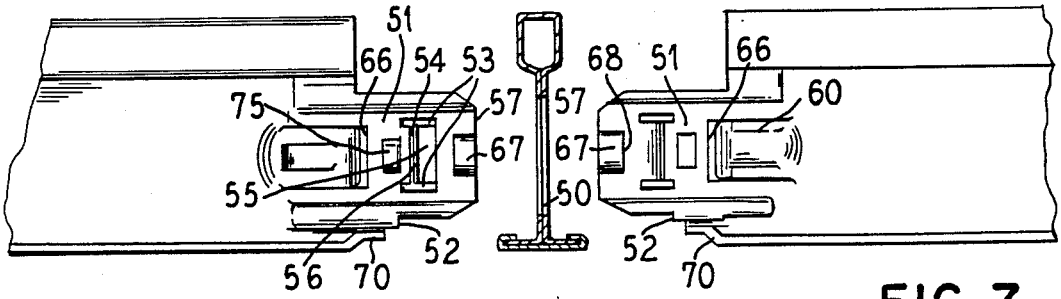
FIG. 5 is an exploded view showing a connection of a pair of cross members with a main runner in accordance with the present invention.
Figure 6:
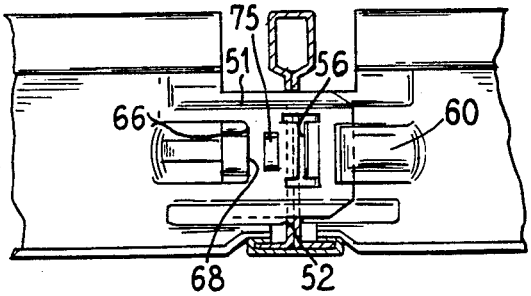
FIG. 6 is a view similar to FIG. 5 with the cross members being connected together and to the main runner member.

To form the system having the runners 11 and 12, a connection between the cross members and main member such as illustrated in FIGS. 5 and 6 is preferably utilized. Briefly this connection involves the main runner 11 having an H-shaped aperture 50, which receives connecting tongues 51 from each of the cross members 12. Each of the tongues 51 are integrally formed with the web 20 and preferably have the structure disclosed is the allowed patent application, Ser. No. 744,625, filed June 14, 1985 which issued as U.S. Pat. No. 4,601,153 July 27, 1986 and whose disclosure is incorporated by reference thereto. This particular connection enables relief of expansion forces during a fire.

The tongue 51 has a shoulder 52 which will limit the insertion of the tongue into the aperture 50. Each of the tongues has a pair of parallel slots 53 which are interconnected by a vertical slot 54 which form a tab 55 having an edge 56 for engaging a portion of the web of the main runner adjacent the aperture 50. The edge 56 as well as the shoulder such as 52 coact to hold the cross member or runner 12 in the assembled position in the main runner 11.

To form a connection between two cross members extending from opposite direction, each of the tongues near a base is provided with a tab or strap 60 which receives the leading end 57 of the opposite tongue. The strap 60 is formed and pressed out of the plane of the web and forms an abutment or engagement surface 66. Each of the tongues adjacent the free end 57 is provided with a lateral projection 67 which is bent along two parallel bends from the plane of the tongue to form an abutment surface 68 which will engage the abutment surface 66 adjacent the base of the other tongue as illustrated in FIG. 6. At the same time, the leading end 57 of the tongue is received or engaged by the strap 60. To prevent the two layers of the web from separating, a stitch 75 can be formed.

In the assembled position it can be seen that the shoulders 52 engage the web of the main runner 11 while the edges 56 are engaged on the portion of the web adjacent the aperture 50. At the same time, the abutment surfaces 66 and 68 are in engagement to interlock the tongues together. As illustrated, a flange of the cross runners has an offset portion 70 which rests on the flange of the main runner.

Figure 7:
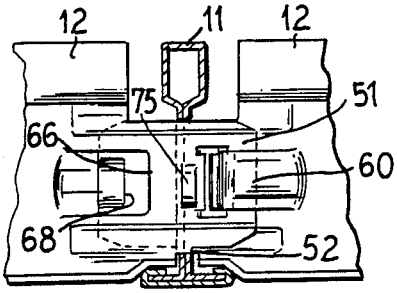
FIG. 7 is a view showing the yeilding of the cross members at the connection in accordance with the present invention after an expansion due to elevation of temperature such as when a fire has occurred.

As best illustrated in FIG. 7, the joint can allow for compensation of expansion in the cross runners due to a fire. This will cause the shoulders 52 to pierce through the web of the main runner and allow the two cross runners to ride up onto the flange of the main runner 11 as illustrated in FIG. 7. A further discussion of the various mechanisms for relieving stress or expansion forces is disclosed in the above mentioned allowed patent application.

It should be pointed out, that the provisions of the centering means 14 will help maintain the panels 13 in a centered position so that during the initial expansion before the expansion joints such as at the coupling give way and other joints provided in the main runners begin to buckle, a slight increasing of the size of the opening receiving the panel 13 will not allow the panel to drop out. This is especially important when utilizing the narrow flanged runners described hereinabove which have a total width of approximately $\frac{5}{8}$ inch.

Although various minor modifications may be suggested by those versed in the art, it should be understood that I wish to embody within the scope of the patent granted hereon, all such modifications as reasonably and properly come within the scope of my contribution to the art.

I claim:

1. A runner member having an inverted T configuration with a vertical web and two outwardly extending flanges adjacent a bottom edge of the web, said runner member being used with other runner member to form a ceiling system having rectangular openings receiving panels, each of said runner members having means for centering the panel in the rectangular opening, the improvement comprising said means for centering comprising a pair of oppositely extending bumps, each bump being adjacent a cut through the web extending parallel to the flange of the member, said bump having a substantially semi-circular configuration and providing curved camming surfaces for moving a member away from the web as the member moves towards the flange and also laterally along the flange and each bump and cut forming a smooth continuous edge with curved portions which will not interfere with lateral and downward movement of the panel relative to the runner.

2. A runner member according to claim 1, wherein said member has narrow flanges and said means for centering positions the panel to rest on approximately the outer $\frac{3}{4}$ of the flange.

3. In a ceiling system having a plurality of main runner members extending parallel with cross runner members extending transverse to and between the main runner members, each of the runner members having an inverted T configuration with a vertically extending web and two outwardly extending flanges the bottom edge of the web, said runners being arranged to provide rectangular openings for receiving panels with the edges of the panel being supported on the flanges, said runner member having centering means for positioning the panel in the opening, the improvement comprising said centering means comprising a pair of bumps with the bumps extending on opposite sides of the web of each runner, each of said bumps being formed adjacent a cut in the web extending parallel to the flanges with the bumps having substantially semi-circular configurations and providing curved camming surfaces for camming the edges of the panel to a desired position when it is moved verticfally down onto the flanges and moved laterally along the flange, each bump and its cut forming a smooth continuous edge with curved portions which will not interfere with downward and lateral movement of the panel relative to the runner.

4. In a ceiling system according to claim 3, wherein each of the runner members is a narrow flange member with the total width of the two flanges being not greater than $\frac{5}{8}$ of an inch and the bumps having an amount of offset from the web so that a panel will rest on approximately the outer 3/16 of each of said flanges.

5. In ceiling system according to claim 3, wherein said bumps position the panel to rest on approximately an outer $\frac{3}{4}$ of the flange.

6. A runner member having an inverted T configuration with a vertical web and two outwardly extending flanges adjacent the bottom edge of the web, said runner member being used with other runner members to form a ceiling system having rectangular openings for receiving panels, each of said runner members having means for centering the panel in the rectangular opening without interference with any lateral and downward movement of the panel relative to the runner, said means for centering comprising a pair of oppositely extending bumps, each bump being adjacent a cut through the web, said cut extending parallel to the flange of the member, said bump having a substantially semi-circular configuration and providing curved camming surfaces for moving a member away from the web as the member moves towards the flange and also laterally along the flange, and each bump and cut forming a smooth continuous edge with curved portions.

7. A runner member according to claim 6, wherein each of said bumps positions the panel to rest on approximately an outer $\frac{3}{4}$ of the flange.

* * * * *